United States Patent [19]

Liebergesell

[11] Patent Number: 4,871,970

[45] Date of Patent: Oct. 3, 1989

[54] TEST CIRCUIT FOR SETTING THE SYNCHRONIZATION OF A DUAL IGNITION SYSTEM

[76] Inventor: Bodo Liebergesell, Schleissheimerstr. 270, D-8000 München, Fed. Rep. of Germany

[21] Appl. No.: 251,408

[22] Filed: Sep. 29, 1988

[30] Foreign Application Priority Data

Oct. 2, 1987 [DE] Fed. Rep. of Germany ..... 3733401

[51] Int. Cl.[4] ..... F02P 17/00

[52] U.S. Cl. ..... 324/389; 324/380; 324/402

[58] Field of Search ..... 324/378, 380, 381, 382, 324/383, 389, 391, 402, 379; 123/636, 599, 149 D

[56] References Cited

U.S. PATENT DOCUMENTS 2,383,557 8/1943 McClellan et al. ..... 324/389
2,442,649 6/1948 Haskins ..... 324/389
3,411,071 11/1968 Henry ..... 324/389 X
4,608,536 8/1986 Jacobs et al. ..... 324/378 X

*Primary Examiner*—Reinhard J. Eisenzopf
*Assistant Examiner*—Robert W. Mueller
*Attorney, Agent, or Firm*—Raph H. Dougherty

[57] ABSTRACT

A test circuit for setting the synchronizatiom of a dual ignition system, particularly of an aircraft engine dual magneto system, having an oscillator circuit 3, two transformers 23, 24 connected to the oscillator circuit, said transformers receiving the oscillator signal at a cener-tap of their primary windings, in which the primary windings are connected at one end to a common potential and having at least two connections for connecting the test circuit to the ignition system to be tested, said two connections each being connected to the other end of the primary winding 23, 24. Secondary windings 27, 28 of the transformers 23, 24 are connected to indicator elements 29, 30.

4 Claims, 1 Drawing Sheet

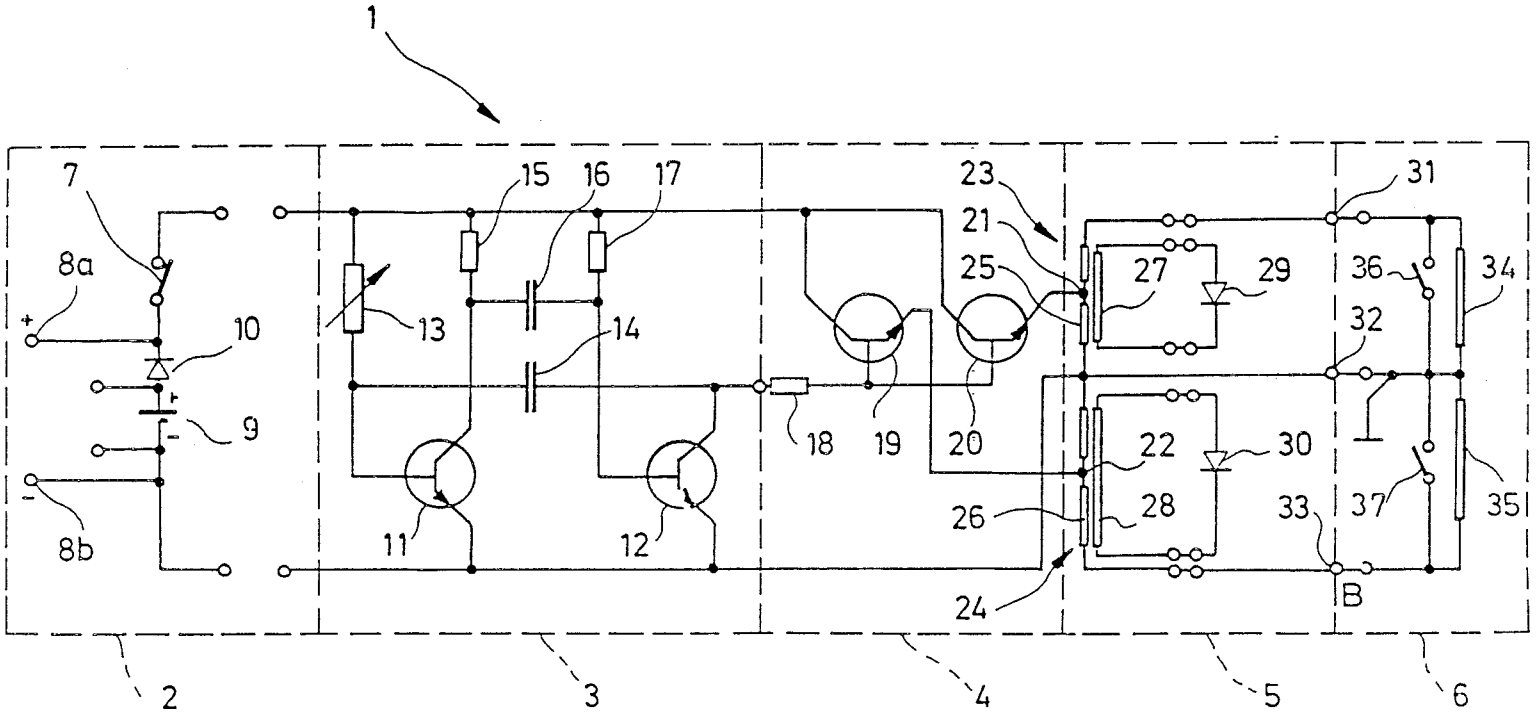
1
2
3
4
5
6
7
8a
8b
9
10
11
12
13
14
15
16
17
18
19
20
21
22
23
24
25
26
27
28
29
30
31
32
33
34
35
36
37
B

TEST CIRCUIT FOR SETTING THE SYNCHRONIZATION OF A DUAL IGNITION SYSTEM

BACKGROUND OF THE INVENTION

The present invention relates to a test circuit for setting the synchronization of a dual ignition system, particularly for a dual magneto system of an aircraft engine.

Dual ignition systems are particularly well suited and advantageous when used for aircraft engines. Aircraft engines are required to achieve maximum possible safety in operation as a primary technical objective. For this reason, systems liable to develop a fault, such as auto-ignition systems, are supplemented by a second parallel system. Aircraft engines, in particular, feature two spark plugs for each cylinder, which plugs are energized by separate ignition systems. It is usual that each of the two ignition systems has a high-tension coil which is coupled to a low-tension coil by a magnetic circuit, the low-tension coil being circuited in parallel to a make/break contact. Actuation of the make/break contacts produce ignition sparks. In a dual magneto system of this kind, both spark plugs must produce an ignition spark in synchronism to each other. For the purpose of setting the synchronization by suitably adjusting the make/break contacts of the dual magneto system, a known relatively complicated electromechanical test circuit is normally used for setting such ignition systems as used in aircraft engines, the known test circuit featuring an electromechanical circuit in the form of a bell generator for producing an alternating current which is applied to the ignition system, in which the indicator elements in the form of jewel lamps indicate the switching condition of the make/break contacts. This known test circuit not only has a relatively high price, this being the reason why this known test circuit finds use as an airport inventory item at best, but is not purchased by any private pilot individually. It also features a non-compact size and high weight, thus making it unsuitable for being included in the flight too kit of a private aircraft. In addition, the operating life and operational safety of the known test circuit have proven to be inadequate.

OBJECTS OF THE INVENTION

It is the primary object of the present invention to advance the technology of a test circuit for setting the synchronization of a dual ignition circuit of the aforementioned type in such way that the test circuit comprises only a few switching elements in an extremely simple circuit arrangement.

It is also an object of this invention to completely eliminate electromechanical components from such test circuit.

It is a further object of this invention to achieve a test circuit apparatus having compact size and low weight.

SUMMARY OF THE INVENTION

The invention provides an oscillator circuit that generates a periodic signal and is connected to each center-tap of each primary winding of two transformers, the primary windings being circuited to a common potential, in which the test circuit features at least two connections for connecting each of two make/break contacts of the ignition system which are connected to the end of the primary windings facing away from the common potential, and in which indicator elements are connected to the secondary windings of the transformers for indicating the presence of a voltage as soon as a certain limiting voltage is exceeded.

The circuit of the invention is insensitive to changes in the input voltage. It operates satisfactorily in a voltage range between 6 and 14 volts in a preferred embodiment of the invention.

BRIEF DESCRIPTION OF THE DRAWING

This invention will be more readily understood by referring to the following detailed description of a preferred embodiment of the invention and the appended drawing, in which:

The single FIGURE is a preferred embodiment of the test circuit for setting the synchronization of an aircraft engine dual magneto system.

DETAILED DESCRIPTION

A test circuit for setting the synchronization of an aircraft engine dual magneto system is identified in its entirety by reference numeral 1. The test circuit 1 comprises a power supply section 2, an oscillator circuit 3, a driver circuit 4 and a sample and hold indicator circuit 5 which can be connected to any dual magneto system 6 which requires testing.

The power supply section 2 incorporates an ON/-OFF switch 7 for switching the test circuit 1 on and off. In addition, the power supply section 2 features two connecting terminals 8*a*, 8*b*, for connecting the test circuit to the electrical system of the aircraft or to some other suitable direct current source. Between the connecting terminals 8*a*, 8*b*, a series arrangement of a battery 9 and a diode 10 is also included in the circuit. The diode 10 has the effect that the battery will supply the test circuit with current only when no external direct current source is connected to the connecting terminals 8*a*, 8*b*.

At its input end the oscillator circuit 3 is connected to the power supply section 2 and contains two switching transistors 11, 12 which are connected together by an RC network as detailed in the following. The base of the first switching transistor 11 is circuited to the positive potential furnished by the power supply section 2 via a first adjustable resistor 13 and is connected to the collector of the second switching transistor via a first capacitor 14. The emitter of the first switching transistor 11 is circuited by a second resistor !5 to the positive potential and via a second capacitor 16 it is connected to the base of the second switching transistor 12. The base of the second switching transistor 12 is also circuited to the positive potential via a relatively high-impedance third resistor 17. Both emitters of the switching transistors 11, !2 are circuited to negative potential or ground potential.

The first resistor 13, together with the first capacitor 14, forms a first frequency-determining element. The second resistor 15, together with the second capacitor 16, forms a second frequency-determining element. The third resistor 17 serves to define the potential assumed by the base of the second switching transistor 1 in a time average at a value between the positive and the negative potential.

The oscillator circuit 3 operates as follows: The first capacitor 14 is charged via the first resistor 13 with a first time constant until the base-emitter switching voltage of the first switching transistor 11 is attained. This then renders the first switching transistor 11 conducting, thus pulling the connection point between the second resistor 15 and the second capacitor 16 to negative potential or to ground potential. At the same time, the base of the second switching transistor 12 is brought to a low potential. At the end of the delay defined by the value of the second resistor 15 and of the second capacitor 16, the base of the second switching transistor 12 attains the base-emitter switching voltage, thus rendering the second switching transistor 12 conducting. At this instant the first switching transistor 11 is returned non-conducting until the instant at which the second capacitor 14 is recharged to the base-emitter switching voltage of the first switching transistor 11. When the value of the first adjustable resistor 13 corresponds to that of the second resistor 15 and the capacities of the capacitors 14, 16 are the same, a square wave having a duty cycle of 0.5 is produced at the output of the oscillator circuit 3. This square wave signal is applied to a first driver transistor 19 and to a second driver transistor 20 via a coupling resistor 18. At the collector end, the driver transistors are connected to positive potential. At the emitter end, they are each connected to a center-tap 21, 22 of a first or second primary winding 25, 26 of a first or second transformer 23, 24.

The transformers 23, 24 have a first and second secondary winding 27, 28 to which a first or second LED 29, 30 is each connected.

The primary windings 25, 26 of the transformers 23, 24 are each connected together at a connecting end, circuited to ground potential and coupled to a ground connection 32 for connection to the ignition system to be tested. At each of their other ends the primary windings 25, 26 are connected to the second and third connections 31, 33 for connecting the test circuit to the ignition system to be tested.

Dual ignition systems in previous art circuit-arrangements comprise two ignition coils or primary windings of ignition coils 34, 35 circuited to a common ground potential, and two make/break contacts 36, 37 circuited in parallel to the ignition coils 34, 35 or to the primary windings of the ignition coils.

To test the synchronization of an ignition system of this kind the test circuit is connected by its ground connection 32 to the ground of the ignition system, and by its second and third connections 31, 33 to the non-grounded connections of the ignition coils or primary windings of ignition coils 34, 35.

The procedure for testing the synchronization is as follows: The oscillator 3 supplies via the driver circuit 4 the center-taps 21, 22 of the primary windings 25, 26 with an (essentially square wave) alternating voltage. When both make/break contacts 36, 37 are closed, the flow of alternating current from the center-tap through the intercoupled components of the primary winding has just the same magnitude as, and is inversely poled to the flow of, alternating current through each of the other components of the primary winding via the make/break contacts to ground. This results in each of the secondary windings 27, 28 producing no, or a very low, alternating voltage due to the lack of symmetry, which is not sufficient, however, to energize the LEDs 29, 30. When, for example, the first make/break contact 36 is opened, the inductance of the first ignition coil or of the primary winding of a ignition coil 34 causes the current flowing from the center-tap to the common connection point of the primary windings to be larger than the flow of current from the center-tap via the other component of the primary winding 25 and via the primary winding of the ignition coil or via the ignition coil 34 itself to ground. This lack of symmetry of these component flows of current in the primary winding results in energizing of the secondary winding 27 which causes the LED to illuminate.

The same operating procedure applies to the second LED 30 when the second make/break contact 37 is open.

This function of the circuit results in each open condition of a make/break contact 36, 37 being indicated by illumination of the corresponding LEDs 29, 30. The test circuit thus permits facilitated adjustment of the two make/break contacts 36, 37 so that they open simultaneously to achieve synchronism of both ignitions.

Instead of the described oscillator circuit, some other alternative oscillator circuit can also be used, although the described oscillator circuit features an extremely simple and advantageous design. When the switching capacity of the two switching transistors 11, 12 is sufficient, the driver stage 4 can be eliminated.

Although the LEDs 29, 30 are extremely favorable as indicator elements since they are not ON (illuminated) until a critical voltage is exceeded, thus compensating for any slight lack of symmetry in the circuit configuration, and while the low contact resistances of the make/break contacts in the lightly used conditions are also compensated, it is nevertheless possible to use some other form or type of indication instead of the disclosed LEDs.

What is claimed is:

1. A test circuit for setting the synchronization of a dual ignition system, particularly for the dual magneto system of an aircraft engine, comprising:

an oscillator circuit (3) for generating a periodic signal;

a pair of transformers (23, 24) connected to said oscillator circuit (3) and in which the periodic signal is applied to a center-tap (21, 22) of the primary windings (25,26) of said transformers and the primary windings (25, 26) are connected to a common potential (32) at one end of a primary winding;

at least two connections (31, 33) for connecting the test circuit (1) to each one of the two make/break contacts (36,37) of the dual ignition system (6) being tested in which the connections (31, 33) are connected to each of the other end of the primary windings (25, 26); and a pair of indicator elements (29, 30), each of which is connected to a secondary winding (27, 28) of the transformers (23, 24) and which are activated whenever the voltage applied to the corresponding secondary winding (27, 28) exceeds a specified value.

2. A test circuit according to claim 1 having respective driver circuits (4, 19, 20) connected between said oscillator circuit (3) and said transformers (23, 24).

3. A test circuit according to claim 1 wherein the oscillator circuit is designed as a transistorized astable multivibrator (3; 11–17).

4. A test circuit according to claim 1 wherein the indicator elements are light emitting diodes (LEDs 29, 30).

* * * * *

UNITED STATES PATENT AND TRADEMARK OFFICE

CERTIFICATE OF CORRECTION

PATENT NO. : 4,871,970

DATED : October 3, 1989

INVENTOR(S) : Bodo Liebergesell

It is certified that error appears in the above—identified patent and that said Letters Patent is hereby corrected as shown below:

In column 1, line 42, change "too" to -- tool --.

In column 2, line 62, change "1" to -- 12 --.

In the Abstract, change line 6, change "cener-tap to --center-tap--.

Signed and Sealed this

Twenty-eighth Day of August, 1990

*Attest:*

HARRY F. MANBECK, JR.

*Attesting Officer*

*Commissioner of Patents and Trademarks*